US005581326A

United States Patent [19]

Ogata et al.

[11] Patent Number: 5,581,326

[45] Date of Patent: Dec. 3, 1996

[54] IMAGE FORMING APPARATUS WHICH SUPPLIES TONER BASED ON COUNTED SIGNAL VALUE

[75] Inventors: Takao Ogata; Yuji Sakemi; Masami Izumizaki, all of Yokohama, Japan

[73] Assignee: Canon Kabushiki Kaisha, Tokyo, Japan

[21] Appl. No.: 350,742

[22] Filed: Dec. 7, 1994

Related U.S. Application Data

[63] Continuation of Ser. No. 838,039, Feb. 21, 1992, abandoned.

[30] Foreign Application Priority Data

Feb. 22, 1991 [JP] Japan ..... 3-050640
Jul. 18, 1991 [JP] Japan ..... 3-202140

[51] Int. Cl.[6] ..... G03G 21/00

[52] U.S. Cl. ..... 355/208; 355/246

[58] Field of Search ..... 355/208, 246, 355/214, 308; 118/688, 693

[56] References Cited

U.S. PATENT DOCUMENTS

| | | | |
|---|---|---|---|
| 4,312,589 | 1/1982 | Brannon et al. | 355/208 |
| 4,626,096 | 12/1986 | Ohtsuka et al. | 355/246 X |
| 4,833,506 | 5/1989 | Kuru et al. | 355/208 |
| 4,847,659 | 7/1989 | Resch, III | 355/208 X |
| 4,963,927 | 10/1990 | Ishihara | 355/208 X |
| 5,124,751 | 6/1992 | Fukui et al. | 355/246 |
| 5,125,045 | 6/1992 | Murakami et al. | 382/50 |
| 5,134,444 | 7/1992 | Tabuchi et al. | 355/208 X |

FOREIGN PATENT DOCUMENTS

| | | | |
|---|---|---|---|
| 0087571 | 5/1983 | Japan | 355/246 |
| 0235872 | 10/1986 | Japan | 355/246 |
| 62-003269 | 1/1987 | Japan . | |
| 0212969 | 9/1988 | Japan | 355/246 |

*Primary Examiner*—Robert Beatty
*Attorney, Agent, or Firm*—Fitzpatrick, Cella, Harper & Scinto

[57] ABSTRACT

In an image forming apparatus for forming an electrostatic latent image corresponding to an image signal and for developing the latent image, a signal value corresponding to an amount of toner consumed by the development is counted by using the image signal. A toner supplement mechanism is controlled on the basis of the signal value, and an error component of the counted signal value. In addition, toner is supplied based on the counted signal value or a detected toner density in accordance with the number of image formations.

10 Claims, 12 Drawing Sheets

IMAGE FORMING APPARATUS WHICH SUPPLIES TONER BASED ON COUNTED SIGNAL VALUE

This application is a continuation of application Ser. No. 07/838,039 filed Feb. 21, 1992, now abandoned.

BACKGROUND OF THE INVENTION

1. Field of the Invention

The invention relates to an image forming apparatus for forming an electrostatic latent image onto an image bearing member and for developing the latent image by a toner and for forming a visible image.

2. Related Background Art

Generally, in a developing apparatus which is provided for an image forming apparatus of the electrophotographic type or electrostatic recording type, a two-component developing agent mainly containing toner particles and carrier particles is used. Particularly, in color image forming apparatuses for forming a full color image or a multicolor image, most developing apparatuses use the two-component developing agent. As is well known, a toner density (a ratio of a weight of toner particles to the total weight of the carrier particles and toner particles) of the two-component developing agent is an extremely important factor in order to stabilize the image quality. The toner particles of the developing agent are consumed in the developing operation, so that the toner density changes. It is therefore, necessary to supply the toner to the developing apparatus and to keep the toner density almost constant.

FIG. 1 shows a whole constructional example of an image forming apparatus having a conventional developing agent density control unit, particularly, a digital copying apparatus of the electrophotographic type. First, an image of an original 31 projected by a lens 32 is read by a CCD 1. The CCD 1 divides the original image into a number of pixels and forms a photoelectric conversion signal (analog signal) corresponding to a density of each pixel. The resultant analog image signal is amplified to a predetermined level by an amplifier 2 and is converted into the digital image signal of, for example, eight bits (0 to 255 gradations) by an analog/digital (A/D) converter 3. The digital image signal is supplied to a gamma (γ) converter (in the embodiment, the γ converter is constructed of a RAM of 256 bytes and executes the density conversion by the lookup table method) 5 and is γ corrected. After that, the digital image signal is supplied to a digital/analog (D/A) converter 9.

The digital image signal is again converted by the analog image signal by the D/A converter 9 and supplied to one input terminal of a comparator 11. A triangle wave signal of a predetermined period which is generated from a triangle wave generating circuit 10 is supplied to the other input terminal of the comparator 11. The analog image signal supplied to one input terminal of the comparator 11 is compared with the above triangle wave signal and pulse width modulated. That is, the image signal having a pulse width corresponding to the density of the relevant pixel is formed. The binary image signal which has been pulse width modulated is supplied to a laser driving circuit 12 and is used as an on/off control signal of the light emission of a laser diode 13. A light emitting time of the laser diode 13 is set to a short time when the pixel density is low, while it is set to a long time when the pixel density is high. A laser beam emitted from the laser diode 13 is scanned by a well-known polygon mirror 14 in the main scanning direction and is irradiated onto an electrophotographic photo-sensitive drum 17 which is made of amorphous silicon, selenium, OPC, or the like and is rotating in the direction shown by an arrow in FIG. 1 through an f/θ lens 15 and a reflecting mirror 16. An electrostatic latent image is, consequently, formed on the drum 17.

On the other hand, the drum 17 is firstly uniformly discharged by an exposing device 18 and is subsequently uniformly charged to, e.g., a minus polarity by a primary charging device 19. After that, the laser beam is irradiated onto the drum 17 and the electrostatic latent image according to the image signal is formed thereon. The electrostatic latent image is inversion developed by a developing device 20, so that a visible image (toner image) is formed (As is well known, the inversion development relates to a developing method whereby the toner is deposited to a region on the photo sensitive material which has been exposed by the light). The toner image is transferred onto a copy transfer material 23 by the operation of a copy transfer charging device 22. The copy transfer material 23 is held on a copy transfer material carrying belt 27 which is provided between two rollers 25 and 26 and is endlessly driven in the direction shown by an arrow in the diagram. The copy transfer material 23 is sent to a fixing device (not shown). Thereafter, any residual toner on the drum 17 is scraped off by a cleaner 24.

Only one image forming station (including the photosensitive drum 17, exposing device 18, primary charging device 19, developing device 20, and the like) is illustrated for simplicity of explanation. In the case of a color copying apparatus, however, for example, four image forming stations having the similar construction for the colors of cyan, magenta, yellow, and black are sequentially arranged over one copy transfer material bearing belt 27 along the moving direction.

Further, to correct the toner density of a two-component developing agent 21 in the developing device 20 which has been changed by the development of the latent image, an output level of the digital image signal of each pixel is accumulated (added) every image. The toner 29 is supplied to the developing device 20 in correspondence to the accumulated value (added value). That is, the output level of each image signal which has been converted into the digital signal by the A/D converter 3 is accumulated by a counter 4. The signal value accumulated by the counter 4 corresponds to an area of toner image which is formed and, accordingly, corresponds to a quantity of toner which is consumed by the development.

The signal value counted by the counter 4 is sent to a central processing unit (CPU) 6. The CPU 6 decides a control amount of a toner supplement mechanism on the basis of the above signal value. That is, the CPU 6 converts the count signal value into the toner supplement amount and sends a toner supplement signal to a motor driving circuit 7. The motor driving circuit 7 drives a motor 28 for only a time corresponding to the toner supplement signal and rotates a toner conveying screw 30 in a toner supplemental vessel 8 conveys toner 29 for only the above time, thereby supplying the toner from the toner supplemental vessel 8 into the developing device 20. As the accumulated signal value is large, therefore, as the area of the toner image which is formed is large, it is presumed that the quantity of toner which is consumed is large, so that the toner supplement time is long.

In an apparatus which determines the toner supplement time in accordance with a signal value range which is determined as a result of a comparison between a counted signal value range with one of a plurality of predetermined signal value ranges rather than a method whereby the toner supplement time is linearly made proportional to the signal value counted by the counter 4, there is only a minute error occurs between the toner consumption amount which is presumed by the counted signal value and the amount of toner which is supplied by the toner supplement time determined. Therefore, even when the toner is supplied at a predetermined timing, the toner density of the developing agent 21 in the developing device gradually differs from the initial set value.

Even in any of the above cases where the toner supplement time is decided as mentioned above and where the toner supplement time is determined so as to be substantially linearly proportional to the signal value accumulated by the counter, so long as the toner is supplied for only a short time, that is, so long as the toner of a very small quantity is supplied, there occurs a variation such that the one toner supplement amount becomes large or small due to an operation variation of the supplement mechanism such as a rotation variation of the screw 30 or the like, an aggregation property of the toner, or the like even if the supplement time is set to the same time.

SUMMARY OF THE INVENTION

It is an object of the invention to provide an image forming apparatus in which a signal value corresponding to an amount of toner which is consumed by the development is counted by using an image signal and a toner supplement mechanism is controlled by using the signal value, wherein a more accurate amount of toner can be supplied.

Another object of the invention is to enable the toner to be supplied while further suppressing a variation in supplement amount in the above image forming apparatus.

According to an aspect of the invention, there is provided an image forming apparatus comprising, counting means for counting a signal value corresponding to an amount of toner which is consumed by the development by using an image signal, control means for deciding a control amount of a supplement mechanism on the basis of the signal value counted by the counting means and for making the supplement mechanism operative in accordance with the control amount, and correcting means for making the supplement mechanism operative in accordance with an error amount occurring upon determination of the control amount.

According to another aspect of the invention, there is provided an image forming apparatus comprising, counting means for counting a signal value corresponding to an amount of toner which is consumed by the development by using an image signal, and control means for making supplement mechanism operative in accordance with the signal value counted by the counting means, wherein the control means makes the supplement mechanism inoperative when the signal value is smaller than a predetermined threshold value.

DETAILED DESCRIPTION OF THE PREFERRED EMBODIMENTS

Figure 1:
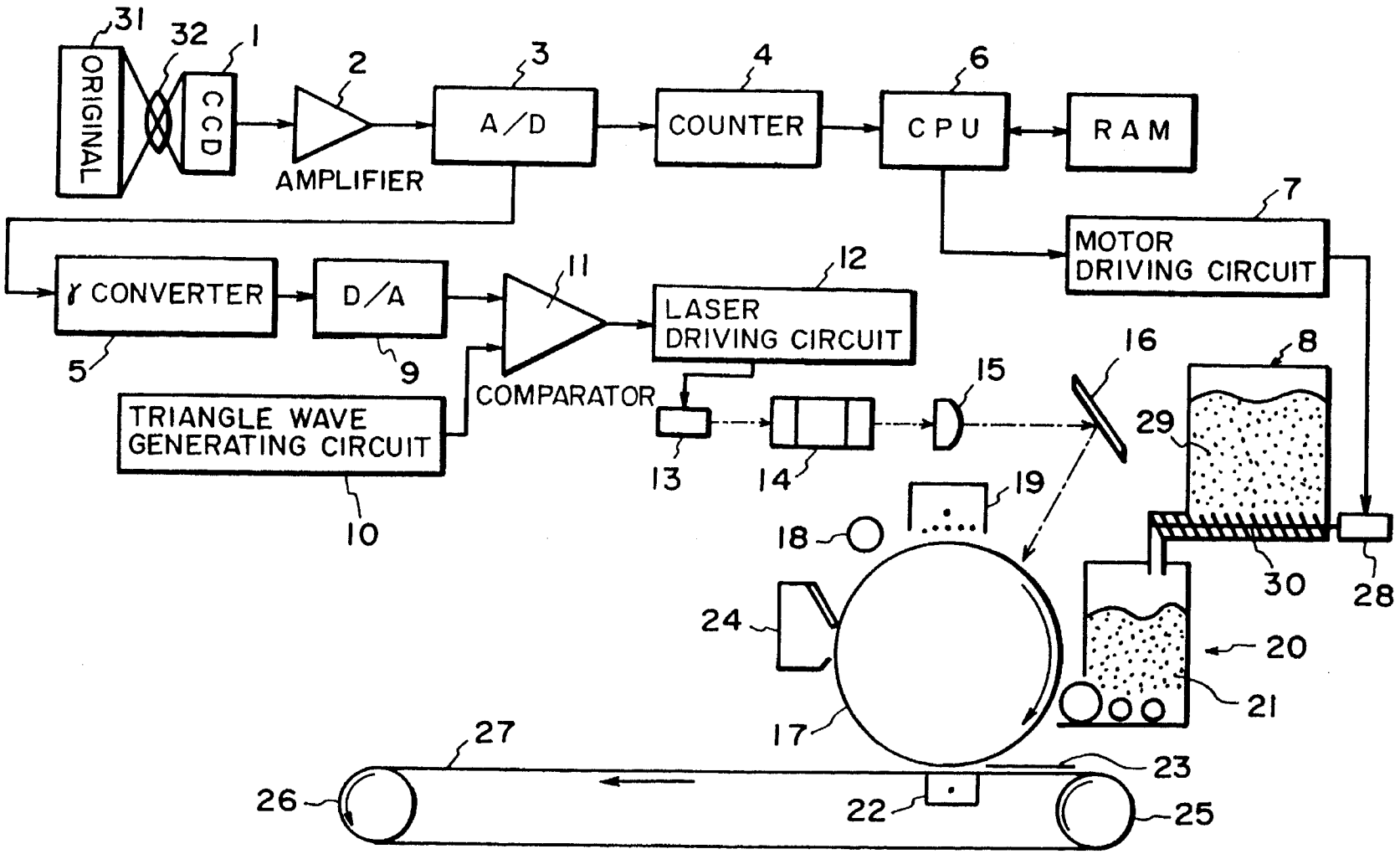
FIG. 1 PRIOR ART
FIG. 1 is an explanatory diagram of a conventional technique.

Parts, components, and means in the following embodiments having the same functions as those shown in the apparatus of FIG. 1 are designated by the same reference numerals and their descriptions are omitted unless otherwise specified as necessary.

Figure 2:
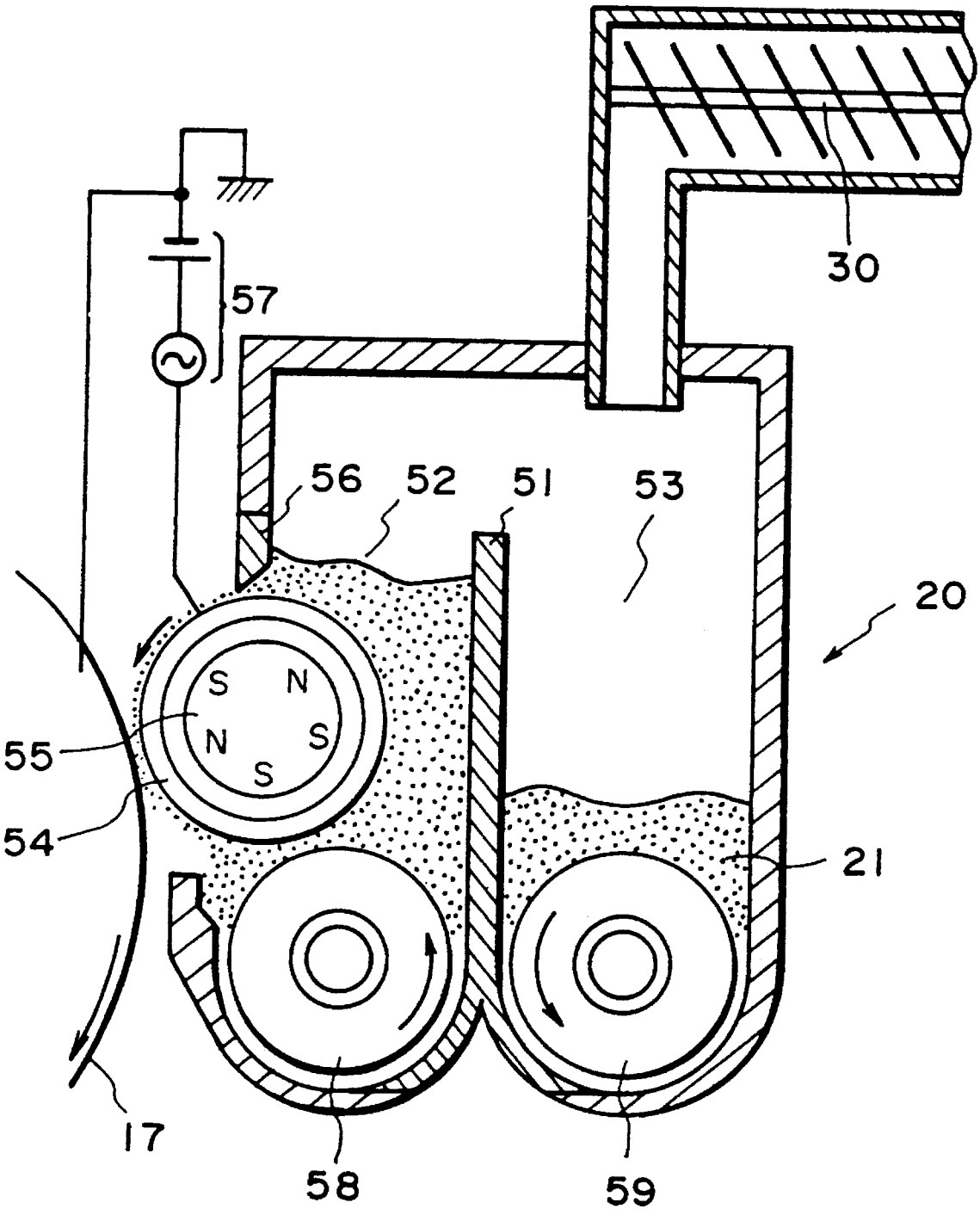
FIG. 2 is an explanatory diagram of a developing device which can be used in the invention.

An example of a developing device which can be used in the invention will first be described with reference to FIG. 2.

The developing device 20 is arranged so as to face the drum 17. The inside of the developing device 20 is partitioned into a first chamber (developing chamber) 52 and a second chamber (agitating chamber) 53 by a partition wall 51 existing in the vertical direction. A nonmagnetic developing sleeve 54 which rotates in the direction indicated by an arrow is arranged in the first chamber 52. A magnet 55 is fixed in the developing sleeve 54. The developing sleeve 54 carries and conveys a layer of the two-component developing agent (containing magnetic carriers and a nonmagnetic toner) whose layer thickness is restricted by a blade 56 and supplies the developing agent to the drum 17 in the developing region, thereby developing the electrostatic latent image. To improve a developing efficiency, namely, an applying ratio of the toner to the latent image, a development bias voltage in which a DC voltage is multiplexed to an AC voltage is applied to the developing sleeve 54 from a power source 57.

Developing agent agitating screws 58 and 59 are arranged in the first and second chambers 52 and 53, respectively. The screw 58 agitates and conveys the developing agent in the first chamber 52. The screw 59 stirs and conveys both of the toner 29 supplied from the toner supplement vessel 8 by the rotation of the toner conveying screw 30 and the developing agent 21 already existing in the developing device, thereby making the toner density uniform. Developing agent passages (not shown) to mutually communicate the first and second chambers 52 and 53 in the edge portions on the front and rear sides in FIG. 2 are formed in the partition wall 51. The developing agent in the first chamber 52 whose toner density has been reduced due to the consumption of the toner by the development is moved from one passage into the second chamber 53 by the conveying forces of the screws 58 and 59. The developing agent whose toner density has been recovered in the second chamber 53 is moved from the other passage into the first chamber 52.

Figure 3:
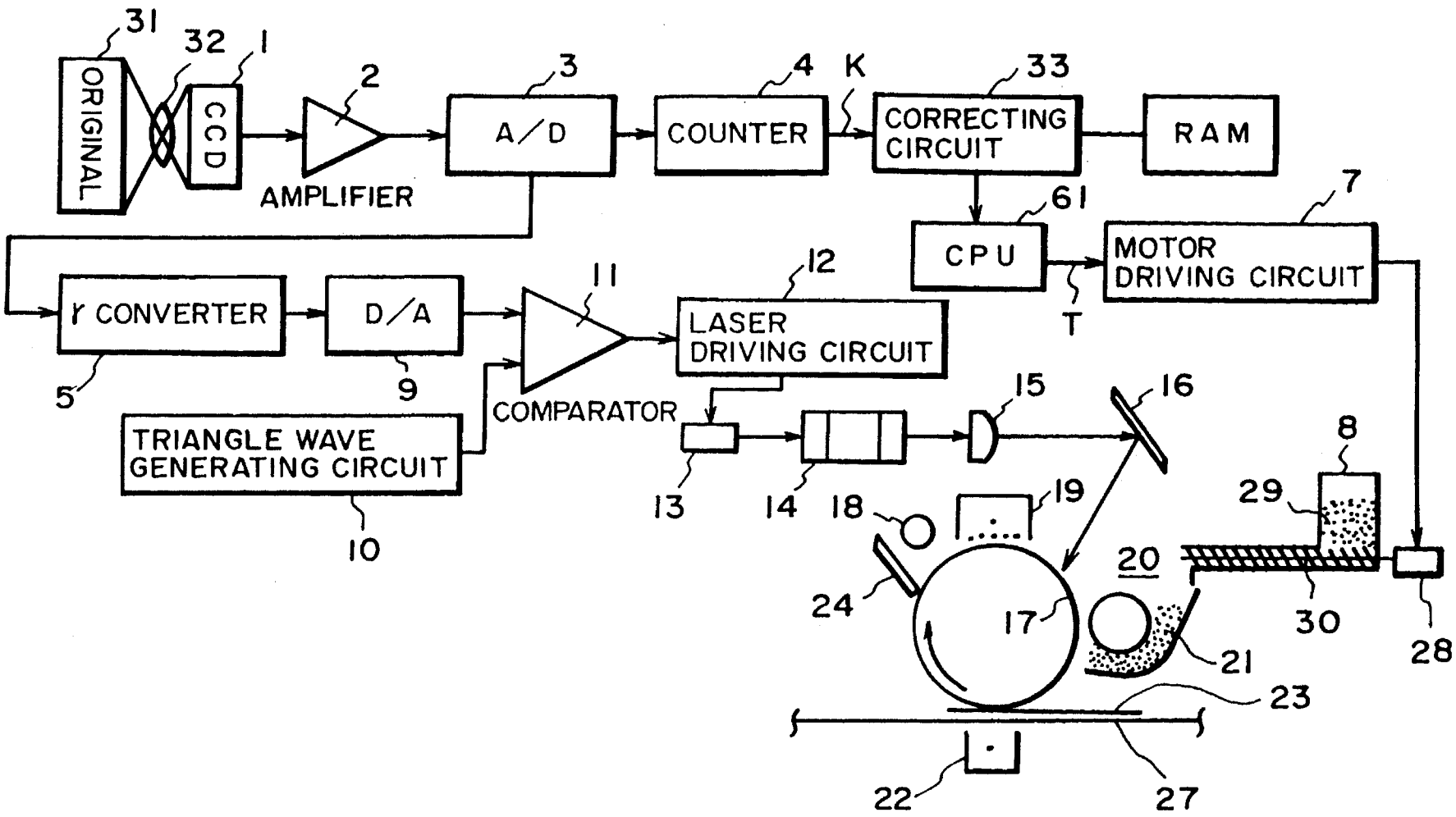
FIG. 3 is an explanatory diagram of an embodiment of the invention.

In FIG. 3, the 8-bit image signal (image signal having 256 gradations from the density level 0 to the density level 255) obtained by the A/D converter 3 is sent to the counter 4. The counter 4 accumulates (adds) the density level value of each image signal (each pixel signal). The counter 4 obtains the accumulated value signal as 32-bit data from the 8-bit image signal.

Figure 4:
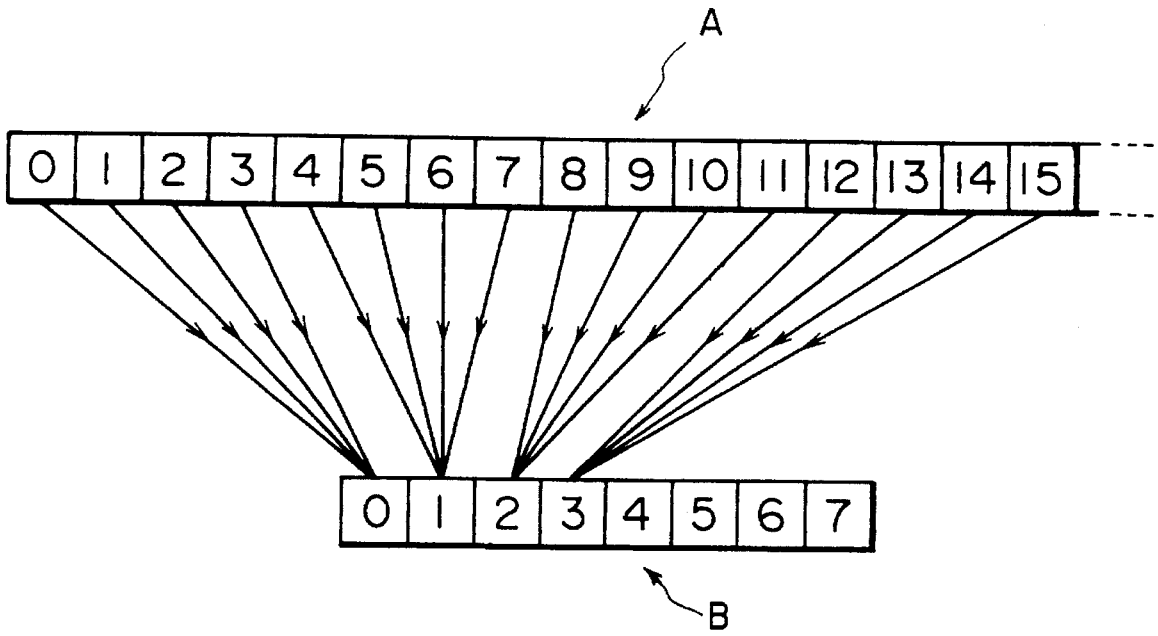
FIG. 4 is an explanatory diagram of an example of the correspondence relation between the accumulated signal value and the toner supplement amount.

On the other hand, a CPU 61 converts the 32-bit accumulated value signal into a toner supplement mechanism control amount signal as 8-bit data. In other words, the CPU 61 converts the 32-bit signal value into an 8-bit supplement motor drive time signal. The conversion from the 32-bit data into the 8-bit data by the CPU 61 is executed as shown in FIG. 4. That is, first four bits 0 to 3 of the 32-bit data shown by A in FIG. 4 are set into the first bit 0 of the 8-bit data shown by B. Similarly, next four bits 4 to 7 of the 32-bit data A are set into the second bit 1 of the 8-bit data. Next four bits 8 to 11 are set into the third bit 2. Next four bits 12 to 15 are set into the fourth bit 3. The conversion is hereinafter executed in a manner similar to that mentioned above.

Figure 5:
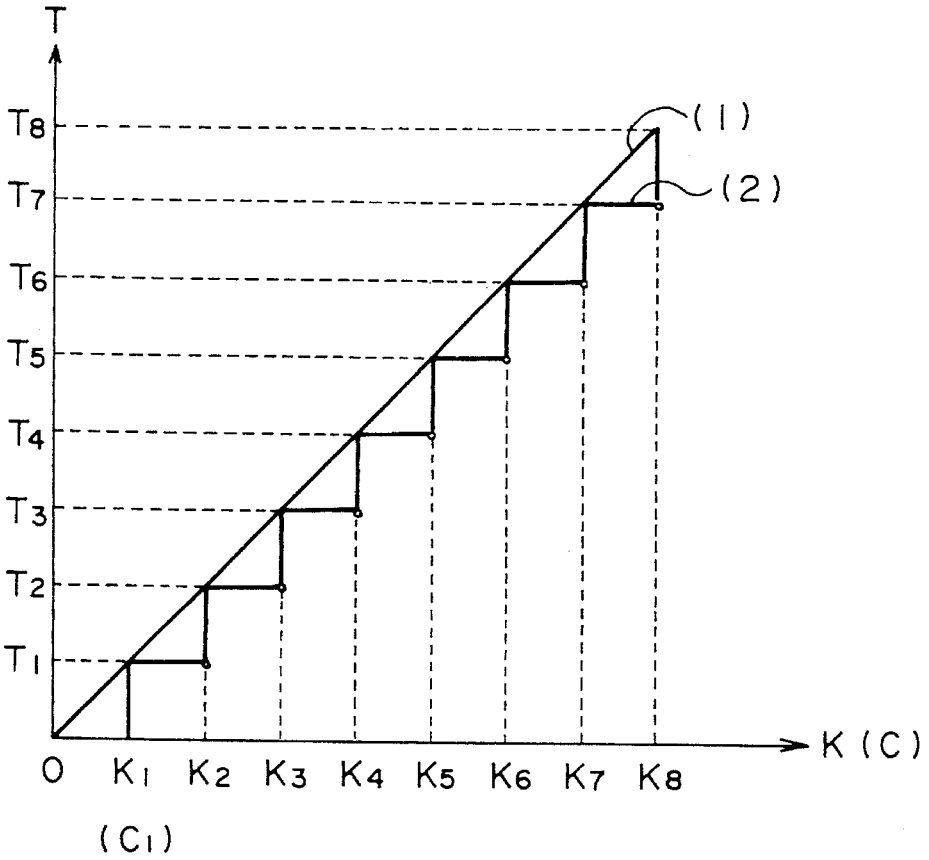
FIG. 5 is an explanatory diagram showing another example of the correspondence relation between the accumulated signal value and the toner supplement amount.

Although the accumulated signal value is the 32-bit data as mentioned above, since the toner supplement amount is the 8-bit data, there is an almost linear proportional relation as shown by a straight line ① in FIG. 5 between the accumulated signal value and the toner consumption amount. However, the relation between the accumulated signal value and the toner supplement amount is expressed by a Gaussian function as shown. by a straight line ② in FIG. 5. That is, when an accumulated signal value K is such that $0 \leqq K < K_1$ (corresponding to the first four bits), a toner supplement amount (toner supplement time) T is converted into the data of 0 and no toner is supplied. When $K_1 \leqq K < K_2$, the toner supplement amount T is converted into data $T_1$ and the toner is supplied by only an amount corresponding to the time $T_1$. When $K_2 \leqq K < K_3$, the toner supplement amount T is converted into data $T_2$ and the toner is supplied by only an amount corresponding to the time $T_2$. The similar operations are also similarly performed hereinbelow. Therefore, for instance, all of accumulated signal values K' which are larger than $K_3$ and smaller than $K_4$ are converted into the data of the same toner supplement amount $T_3$. Therefore, when the accumulated signal value is converted into the toner supplement amount, a minute error of $\Delta K$ ($=K'-K_3$) occurs. As mentioned above, since the toner supplement amount is determined hitherto by ignoring the minute error $\Delta K$ occurring upon such a conversion, there is a serious drawback such that the developing agent density is largely deviated from the allowable range of the initial set value. (In FIG. 5, an axis of abscissa indicates a level of the accumulated signal value and an axis of ordinate indicates a driving time of the toner supplement motor 28. Therefore, the axis of ordinate corresponds to the toner supplement amount of one time).

In the embodiment, the 32-bit data from the counter 4 is sent to a correcting circuit 33. In the correcting circuit 33, the minute error $\Delta K$ occurring when the signal value of the 32-bit data is converted into the toner supplement amount of the 8-bit data is accumulated every toner supplement. When the accumulated value exceeds a certain constant, for example, $K_1$, the signal value is converted into the toner supplement amount and a control signal is sent from the CPU 61 to the driving circuit 7, thereby allowing the toner to be supplied. By repeating the above processing steps, the minute error is eliminated and the developing agent density is always held to a proper value.

Figure 6:
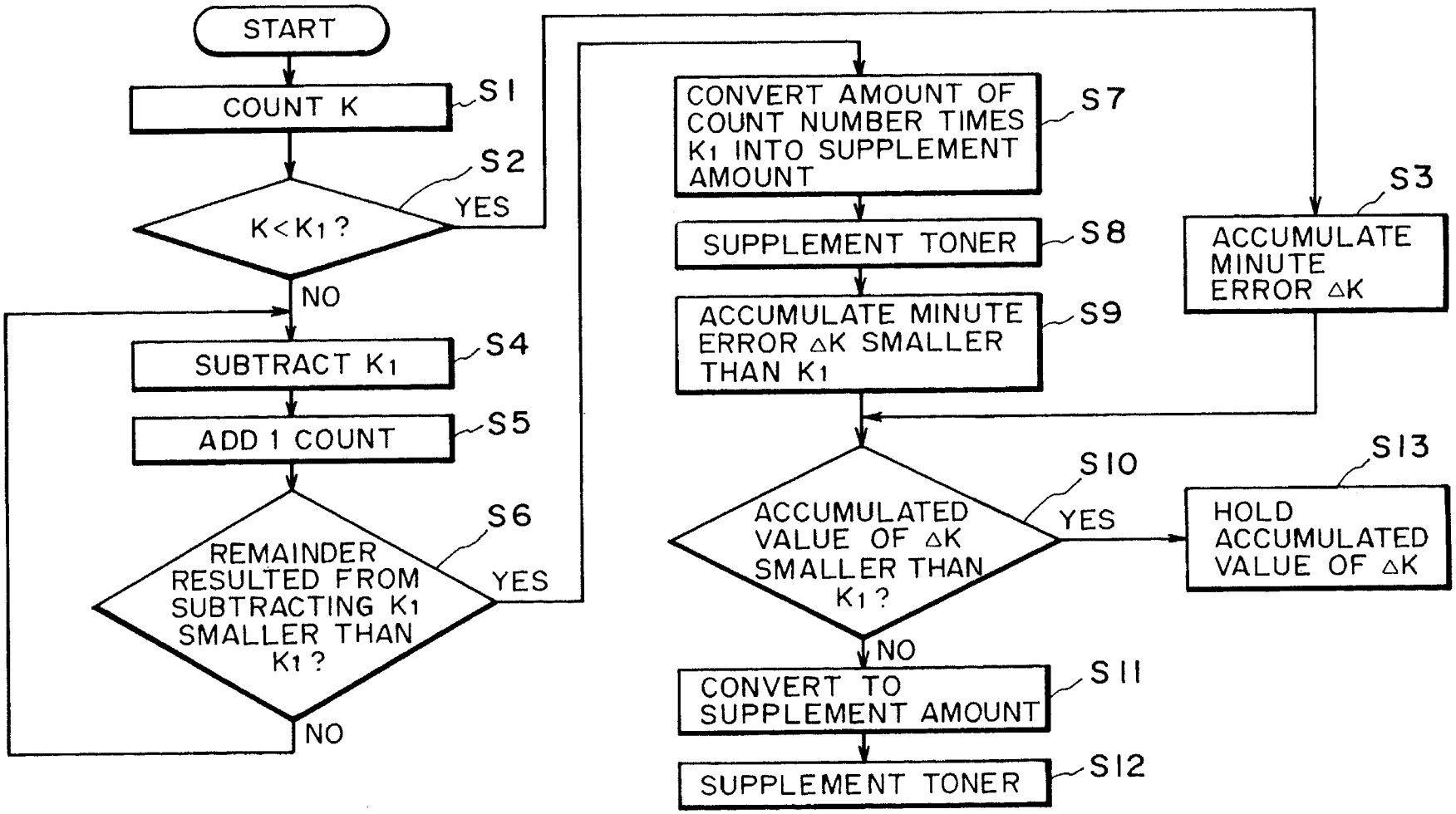
FIG. 6 is a control flowchart of an example of the invention.

The operation of the embodiment mentioned above will now be described in detail with reference to a flowchart of FIG. 6. First, in step S1, the density level of each image signal is counted, thereby obtaining the signal value K. The accumulated signal value K is compared with the signal value level $K_1$ for the minimum supplement in step S2. When $K<K_1$ (YES in step S2), it is determined that the minute error $\Delta K$ exists, so that the minute error $\Delta K$ is accumulated in step S3. In the next step S10, the accumulated value of the minute error $\Delta K$ is compared with $K_1$. When the accumulated value is smaller than $K_1$ (YES in step S10), the accumulated value is held in step S13. When the accumulated value is equal to or larger than $K_1$ (NO in step S10), the signal value is converted into the supplement amount corresponding to $K_1$ in step S11. The toner is supplied in step S12.

On the other hand, when $K \geqq K_1$ (NO in step S2), $K_1$ is subtracted from K in step S4. The count value of a counter in the CPU 61 is increased by +1 in step S5. In step S6, the remainder in which $K_1$ has been subtracted from K is compared with $K_1$. When the remainder is equal to or larger than $K_1$ (NO in step S6), the processing routine is returned to step S4 and the above operation is continued. When the remainder is smaller than $K_1$ in step S6 (YES in step S6), step S7 follows and a value which is obtained by increasing $K_1$ by the count number times (count number in step S5) ($K_1$ to $K_8$ in FIG. 5) is converted into the toner supplement amount (toner supplement time; $T_1$ to $T_8$ in FIG. 5). In step S8, the toner corresponding to the converted supplement amount is supplied. In the next step S9, the minute error $\Delta K$ smaller than $K_1$ is accumulated.

After that, in step S10, the accumulated value of the minute error $\Delta K$ is compared with $K_1$. When the accumulated value is smaller than $K_1$, the accumulated value is held in step S13. When the accumulated value is equal to or larger than $K_1$, the signal value is converted into the supplement amount corresponding to $K_1$ in step S11. The toner is supplied in step S12.

By repeating the above operation, the toner of the minute error amount can be supplied and the toner density of the developing agent can be certainly held to a value within a proper value. In the embodiment, when the accumulated value of the minute error reaches the signal value level $K_1$ for minimum supplement or exceeds $K_1$, the signal value is converted into the supplement amount. However, a proper constant other than $K_1$ can be also set.

Figure 7:
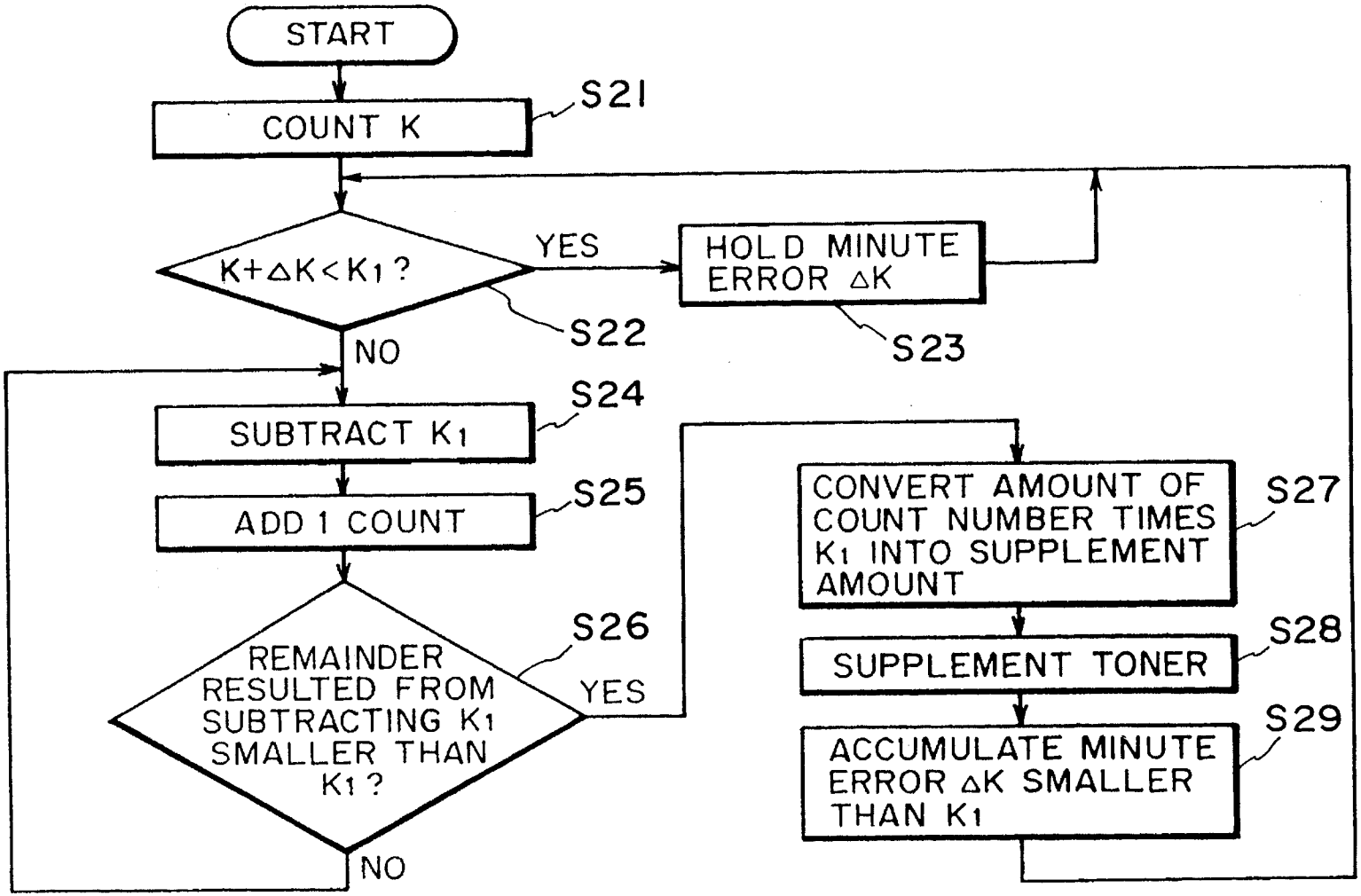
FIG. 7 is a control flowchart of another example of the invention.

In the embodiment, the minute error $\Delta K$ occurring every toner supplement of one time is accumulated and when the accumulated value is equal to or larger than a predetermined value, the signal is converted into the supplement amount and the toner is supplied. However, it is also possible that the minute error $\Delta K$ occurring at the time of the toner supplement of one time is accumulated to the next accumulated signal value K and the resultant signal value is converted into the supplement amount. The operation in such a case will now be described with reference to a flowchart shown in FIG. 7.

First, in step S21, the signal value K is counted in a manner similar to that mentioned above. The minute error $\Delta K$ is accumulated to the signal value K (However, $\Delta K$ does not always exist. For instance, $\Delta K$ does not exist just after the start of the operation or in the case where no minute error occurs when the 32-bit data is converted into the 8-bit data).

In step S22, (K+ΔK) is compared with the signal value level $K_1$ for the minimum supplement. When $(K+\Delta K)<K_1$ (YES in step S22), it is determined that the minute error ΔK has occurred. It is stored into, for instance, a memory in step S23, thereby holding it. The minute error ΔK is accumulated to the signal value K at the next time.

On the other hand, when $(K+\Delta K)\geqq K_1$ (NO in step S22), $K_1$ is subtracted from (K+ΔK) in step S24. The count value of the counter in the CPU 61 is increased by +1 in step S25. The remainder in which $K_1$ has been subtracted from (K+ΔK) is compared with $K_1$ in step S26. When the remainder is equal to or larger than $K_1$ (NO in step S26), the processing routine is again returned to step S24 and the above operation is continued. When the remainder is smaller than $K_1$ in step S26 (YES in step S26). The value which is obtained by increasing $K_1$ by the count number times (($K_1$ to $K_8$) in FIG. 5) is converted into the supplement amount (($T_1$ to $T_8$) in FIG. 5) in step S27. The toner corresponding to the converted supplement amount is supplied in step S28. In the next step S29, the minute error ΔK smaller than $K_1$ is held. The minute error ΔK is accumulated to the next signal value K.

That is, the signal value K in the copying operation at the first time is converted into the supplement amount and the toner corresponding thereto is supplied. The minute error ΔK occurring at that time is accumulated to the signal value K in the copying operation at the second time. The accumulated signal value (K+ΔK) is converted into the supplement amount and the toner corresponding thereto is supplied. The minute error ΔK occurring at that time is accumulated to the signal value K in the copying operation at the third time. The accumulated signal value (K+ΔK) is converted into the supplement amount and the toner corresponding thereto is supplied. By repeating the above operations hereinafter, the minute error occurring when the signal value is converted into the supplement amount is eliminated.

The above correcting operation is executed in the correcting circuit 33 in FIG. 3.

Figure 8:
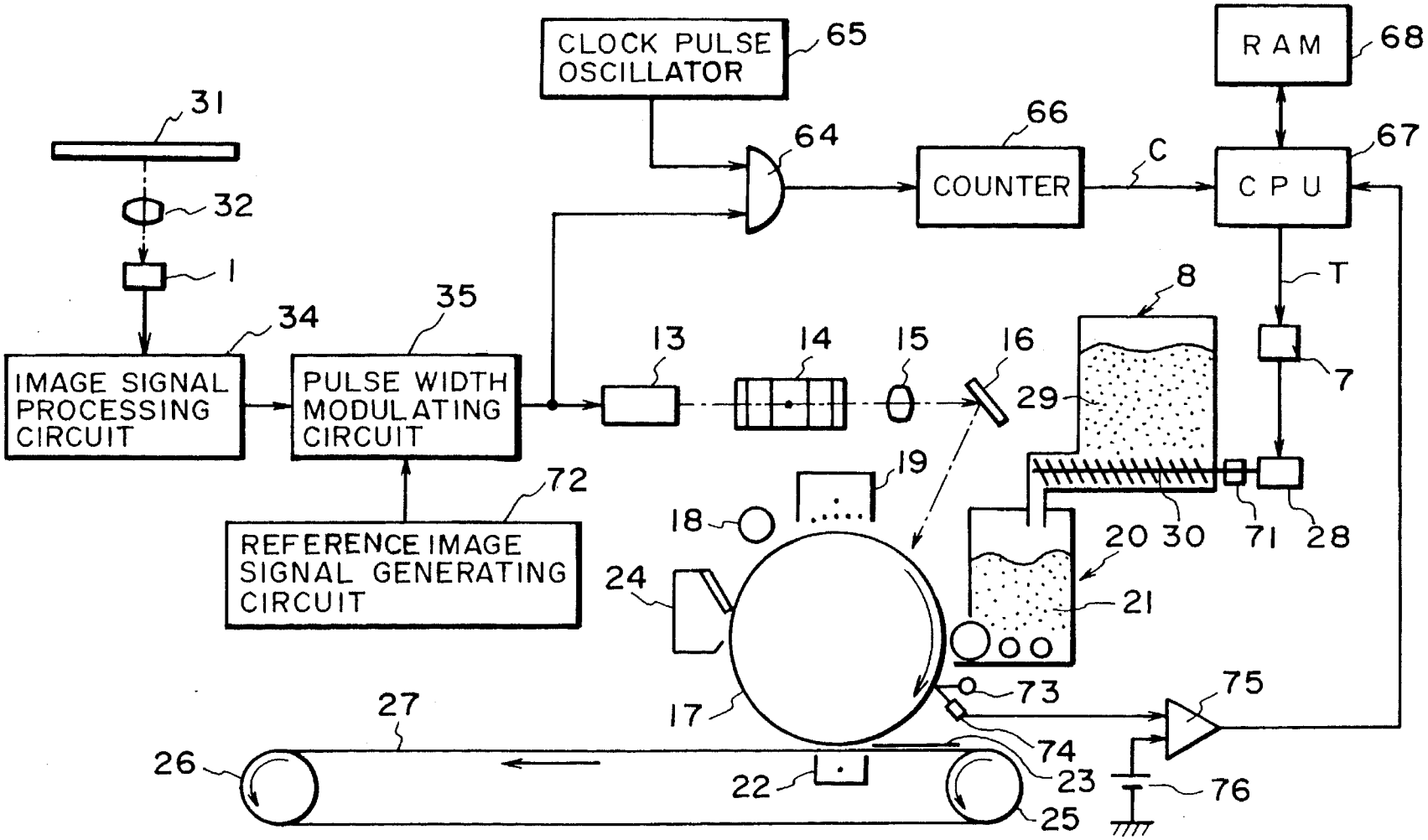
FIG. 8 is an explanatory diagram of another embodiment of the invention.

In the example of FIG. 8, the analog signal formed by the image pickup device (CCD) 1 is supplied to an image signal processing circuit 34 including the circuits 2, 3, and 5 in FIG. 1 and is converted into the pixel image signal having an output level corresponding to a density of the pixel in the image. The pixel image signal is sent to a pulse width modulating circuit 35 including the circuits 9, 10, and 11 in FIG. 1.

Figure 9A:
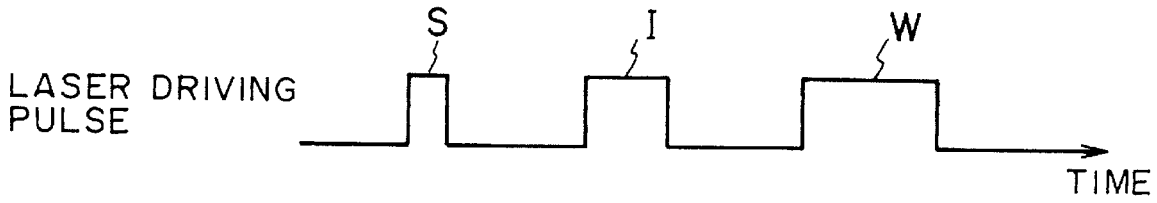
FIGS. 9A to 9D are explanatory diagrams of a counting method of an image signal in the example of FIG. 8.

For every pixel image signal which is supplied to the pulse width modulating circuit 35, a laser driving pulse of a width (time length) corresponding to the level of the pixel image signal is formed and generated. That is, as shown in FIG. 9A, a driving pulse W of a wider width is formed for the pixel image signal of a high density. A driving pulse S of a narrower width is formed for the pixel image signal of a low density. A driving pulse I of an intermediate width is formed for the pixel image signal of an intermediate density.

Figure 9B:
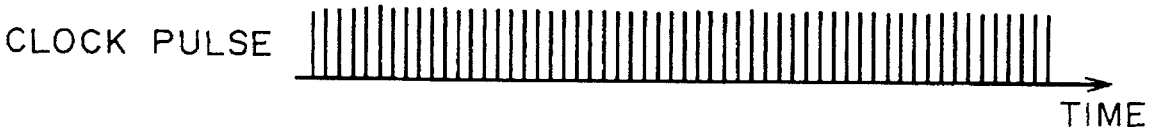
Figure 9C:
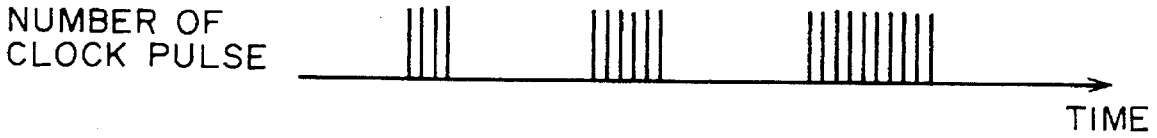
Figure 9D:
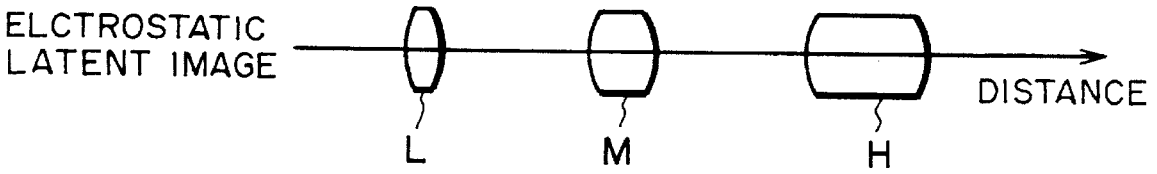

The laser driving pulse generated from the pulse width modulating circuit 35 is supplied to the semiconductor laser 13, thereby allowing the laser 13 to emit the light by only the time corresponding to the pulse width. Therefore, the laser 13 is driven for a longer time for the high density pixel and is driven for a shorter time for the low density pixel. Consequently, a long range on the drum 17 is exposed by the main scanning direction for the high density pixel by the foregoing optical system and a short range is exposed for the low density pixel in the main scanning direction. That is, a dot size of the electrostatic latent image differs in correspondence to the density of the pixel. Consequently, a toner consumption amount for the high density pixel is obviously larger than that for the low density pixel. FIG. 9D shows electrostatic latent images of the pixels of low, middle, and high densities by reference characters L, M, and H, respectively.

The above description is substantially the same as that in each of the foregoing embodiments.

Only one image forming station is shown in FIG. 8 for simplicity of explanation. However, in the case of the color image forming apparatus, for instance, four image forming stations corresponding to the respective colors of cyan, magenta, yellow, and black are sequentially arranged over one copy transfer material carrying belt 27 along the moving direction. Electrostatic latent images of the respective colors in which the image of the original are color separated are sequentially formed onto the photosensitive drums of the image forming stations and are developed by developing devices having the corresponding color toners. The developed images are sequentially copy transferred to one copy transfer material 23 which is held and conveyed by the carrying belt 26 (Above operations are also similar to those in the example of FIG. 3).

The level of the output signal of the image signal processing circuit 34 is counted for every pixel in order to correct the developing agent density in the developing device 20 which has been changed by the development of the electrostatic latent image, namely, to control an amount of toner which is supplied to the developing device 20. In the embodiment of FIG. 8, the above counting operation is executed in the following manner.

An output signal of the pulse width modulating circuit 35 is supplied to one input terminal of an AND gate 64. A clock pulse (pulse shown in FIG. 9B) is supplied to the other input terminal of the AND gate from a clock pulse oscillator 65. Therefore, the clock pulses of the numbers corresponding to the pulse widths of the laser driving pulses S, I, and W, that is, the clock pulses of the numbers corresponding to the densities of the respective pixels are generated from the AND gate 64 as shown in FIG. 9C. The number of clock pulses is accumulated by a counter 66 every image. A pulse accumulation signal C of one image from the counter 66 corresponds to the area of the toner image and, therefore, corresponds to an amount of toner which is consumed from the developing device 20 in order to form one toner image of the original 31.

The accumulation signal value C is supplied to a CPU 67 and stored into an RAM 68. The CPU 67 has a conversion table indicative of the correspondence relation between the accumulation signal value C and the toner supplement time T. The CPU 67 calculates a rotation driving time (i.e., toner supplement time) T of the conveying screw 30 which is required to supply the toner of the amount corresponding to the amount of toner which is consumed by the developing device 20 from the toner supplement vessel 8 to the developing device on the basis of the input signal value C. The CPU 67 controls the motor driving circuit 7 and drives the motor 28 by only the calculated time T. Generally, when the signal value C is large, the driving time of the motor 28 becomes longer, and when the signal value C is small, the driving time of the motor 28 becomes shorter.

In the embodiment, the toner supplement time T is calculated in accordance with the straight line ① in FIG. 5 (In the above case, an axis of abscissa in FIG. 5 indicates the accumulated value C of the clock pulses). The toner supplement time T is substantially linearly proportional to the accumulated value C.

The toner supplement time T can be also made substantially linearly proportional to the accumulated value C even by a method whereby a width at each stage of the function ② in FIG. 5 is set to an extremely narrow width such that the foregoing error can be ignored and the toner supplement time T is calculated by the function ②. A driving force of the motor 28 is transferred to the conveying screw 30 through a gear train 71. The screw 30 conveys the toner 29 in the toner supplement vessel 8 and supplies the toner of the amount corresponding to the time T to the developing device 20. The supplying operation of the toner is executed each time the development of one image is finished (Although not shown, it is preferable that the driving force transfer gear train 71 is provided between the motor 28 and the screw 30 in the example of FIG. 3 as well).

In the case of a minute toner supplement amount, when the toner supplement is executed every image as mentioned above, a variation increases and the toner density of the developing agent fluctuates and an image of a stable density is not obtained. According to the embodiment of the invention, therefore, after the signal value C was determined, when the CPU 67 converts the signal value C into the toner supplement time T by the conversion table, the signal value C is compared with a preset threshold value $C_1$ as a signal value corresponding to the lowest line at which the supplement amount of the toner from the toner supplement vessel 8 becomes stable. When the signal value C is equal to or larger than the threshold value $C_1$, the signal value C is converted into the toner supplement time and the toner is supplied in the ordinary manner. On the other hand, when the signal value C is equal to $\Delta C$ smaller than the threshold value $C_1$, the signal value C is not converted into the toner supplement time, accordingly, the toner is not supplied but the signal value $\Delta C$ is stored. When the signal value C is calculated by the next image information signal, the stored signal value $\Delta C$ is accumulated (added) to C and the resultant accumulated value is again compared with the threshold value $C_1$ and the above operations are repeated.

According to another embodiment of the invention, after the CPU 67 converted the signal value C into the toner supplement time T, the time T is compared with the preset threshold value $T_1$ as a toner supplement time corresponding to the lowest line at which the supplement amount of the toner from the toner supplement vessel 8 becomes stable. When the time T is equal to or larger than the threshold value $T_1$, the conveying screw 30 is rotated by only the decided time in the ordinary manner, thereby supplying the toner. On the other hand, when the time T is equal to $\Delta T$ smaller than the threshold value $T_1$, the screw 30 is not rotated, so that the toner is not supplied but the minute time $\Delta T$ is stored. When the time T is calculated by the next image information signal, the stored minute time $\Delta T$ is accumulated (added) and the resultant accumulated value is again compared with the threshold value $T_1$ and the above operations are repeated.

According to the invention, therefore, when the calculated supplement time is very short, the toner is not supplied for every image but the toner is supplied in a lump when the supplement amount of the toner from the toner supplement vessel 8 reaches the quantity corresponding to the lowest line at which the supplement amount becomes stable. Therefore, the toner of the correct amount such that a variation in toner supplement amount which occurs in the case of the minute toner supplement is suppressed is supplied. The fluctuation of the toner density of the developing agent can be prevented.

The supplement method such that the output level of each pixel of the digital image signal obtained by photoelectrically converting the image of the original to be copied is accumulated and the accumulated value is converted into the toner supplement amount and the toner of the amount corresponding thereto is supplied to the developing device is merely a presumed supplement. Therefore, when the toner supplement amount from the toner supplement vessel 8 to the developing device or the toner consumption amount from the developing device changes from a presumed value due to some causes such as a large humidity change and the like, the toner density of the developing agent in the developing device is gradually deviated from the initial set value (specified value). Unless such a deviation is not corrected, the toner density will be largely deviated from the allowable range of the initial set value. According to the embodiment, therefore, a toner density detecting apparatus is provided and is made operative at a predetermined timing such that each time the toner supplement is executed as mentioned above, each time one copying operation is finished, each time the number of copy sheets reaches a predetermined number, each time the sum of the signal values C at the respective times reaches a predetermined value, or the like.

When explaining in detail, a reference image signal generating circuit 72 for generating a reference image signal having the signal level corresponding to a predetermined density is provided. A reference image signal is supplied from the generating circuit 72 to the pulse width modulating circuit 35 so as to generate a laser driving pulse having the pulse width corresponding to the predetermined density. The laser driving pulse is supplied to the semiconductor laser 13 so as to emit the light. The drum 17 is scanned by the laser beam emitted from the laser 13 (At that time, the counter 66 is not made operative). Thus, a reference electrostatic latent image corresponding to the preset density is formed on the drum 17 and is developed by the developing device 20. A light is irradiated to the patch-like reference toner image obtained as mentioned above from a light source 73 such as an LED or the like. The reflected lights are received by a photoelectric converting device 74. An output signal of the device 74 corresponds to the density of the reference toner image, so that such an output signal eventually corresponds to the actual toner density of the two-component developing agent 21 in the developing device 20.

The output signal of the photoelectric converting devices 74 is supplied to one input terminal of a comparator 75. A reference signal corresponding to the specified toner density (toner density at the initial set value) of the developing agent 21 is supplied to the other input terminal of the comparator 75 from a reference voltage signal source 76. Therefore, the comparator 75 compares the specified toner density with the actual toner density in the developing device. As a result of the comparison of both of the input signals, therefore, the comparator 75 generates an output signal indicating that the actual toner density of the developing agent 21 in the developing device 20 is larger than the specified value or an output signal indicating that the toner density is smaller than the specified value. When there is no difference between both of the input signals, an output signal indicative of such a state can be also generated.

The output signal of the comparator 75 is supplied to the CPU 67. In the embodiment, the CPU 67 controls so as to correct the toner supplement time at the next time on the basis of the output signal from the comparator 75. For instance, when the actual toner density of the developing agent 21 detected by the photoelectric converting device 74 is smaller than the specified value, namely, when the toner supplement amount is insufficient, the CPU 67 makes the screw 30 operative so as to supply the toner of the lack amount detected by the comparator 75 and the toner of the amount corresponding to the signal value C to the developing device 20. That is, the screw rotation time is calculated on the basis of the output signal from the comparator 75 and the accumulation signal value C. The motor driving circuit 69 is controlled and the toner is supplied to the developing device 20. When the actual toner density of the developing agent 21 detected by the photoelectric converting device 74 is larger than the specified value, namely, when the toner supplement amount is excessive, the CPU 67 calculates the excessive toner amount in the developing agent on the basis of the output signal from the comparator 75. In the subsequent image formation by the original, the toner is supplied so as to eliminate the excessive toner amount or no toner is supplied until the excessive toner amount is consumed and the image is formed. That is, the image is formed by supplying no toner and the excessive toner amount is consumed. When the excessive toner amount is consumed, the toner supplement operation is executed as mentioned above or the like.

As mentioned above, the toner density detecting apparatus is provided, the actual toner density of the developing agent 21 is detected at a predetermined timing, and the error of the supplement toner amount is corrected on the basis of the signal value C by the counter 66 by using the detected toner density amount, so that the toner density can be always maintained within the allowable range of the initial set value.

The operation of the embodiment of the invention will now be described with reference to flowcharts of FIGS. 10 to 13.

Figure 10:
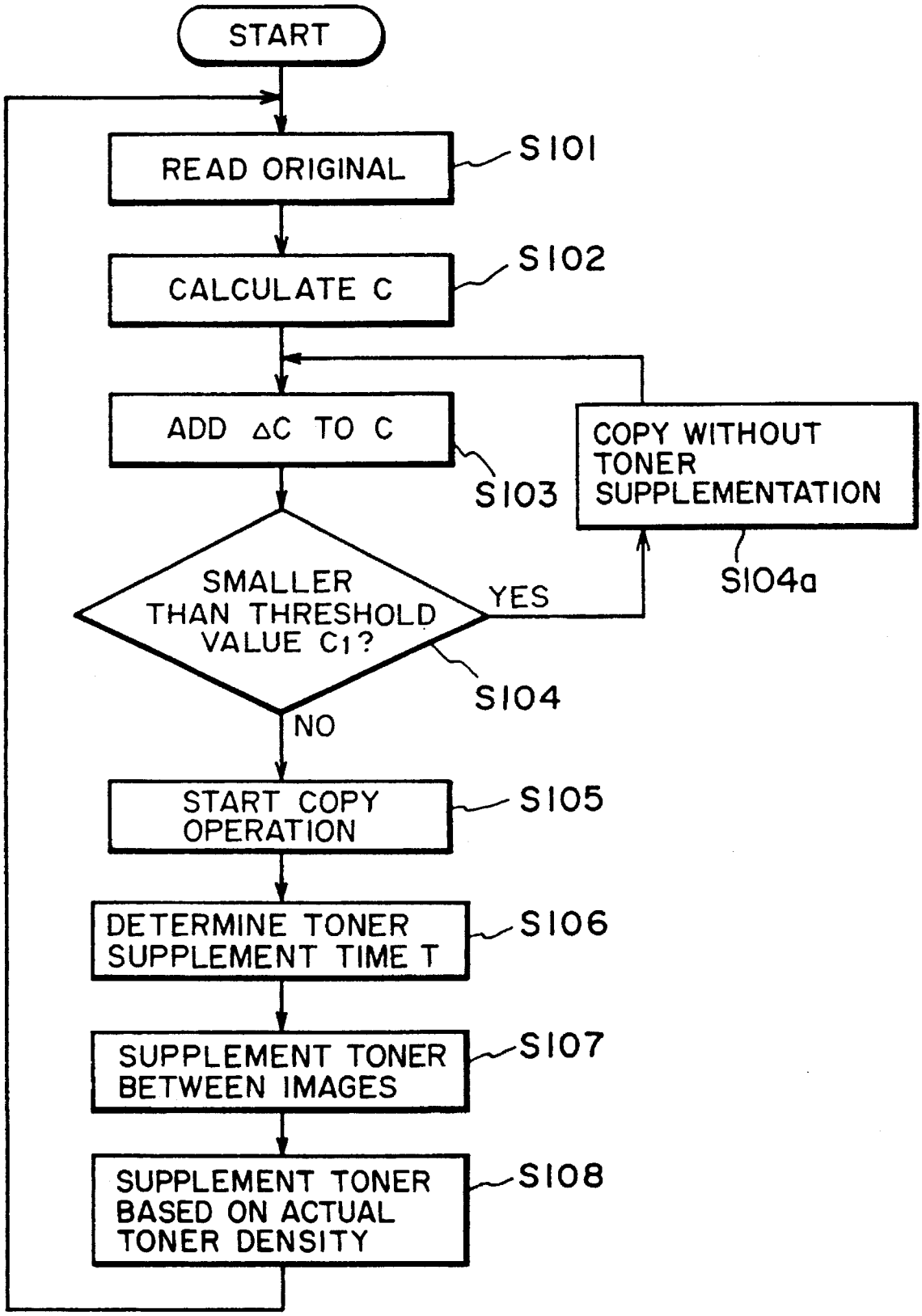
FIG. 10 is a control flowchart of another example of the invention.

First, in the embodiment of FIG. 10, when a start button is depressed to copy the original, the original is read in step S101. A photoelectric conversion signal corresponding to the density of each pixel of the original image is generated. In the next step S102, the output level of each pixel of the digital image signal which is obtained by converting the photo-electric conversion signal into the digital signal is counted and the clock pulse accumulation signal value C is calculated. In step S103, the stored minute value ΔC smaller than the threshold value $C_1$ ($C_1=1\times10^8$ according to the experimental result) is accumulated to the signal value C (However, ΔC does not always exist. For example, ΔC does not exist just after the operation was started or when the preceding value C is equal to $C_1$). In step S104, the accumulated value (C+ΔC) is compared with the threshold value $C_1$. When $(C+\Delta C)<C_1$ (YES in step S104), it is determined that the minute value C exists, copying is performed without toner supplementation (step S104*a*), and C is held in step S103 and is accumulated to the next signal value C.

On the other hand, when $(C+\Delta C)\geqq C_1$ (NO in step S104), control proceeds to step 105, where the copying operation is started and the image forming operations such as formation of the latent image, development, copy transfer, and the like mentioned above are executed. When one toner image is formed, step S106 converts (C+ΔC) into a toner supplement time T. In step S107, the screw 30 is rotated by only the time T decided as mentioned above and the toner is supplied before the next toner image is formed. In the next step S108, the toner density detecting apparatus is made operative. The reference image is formed on the drum 17 and the above operations are performed. That is, the signal value C is converted into the toner supplement time T and a check is made to see if the supplied toner amount was correct or not. When there is an error in the supplement amount, a proper procedure as mentioned above to correct such an error is executed.

The similar operations are repeated hereinbelow every copying operation. The toner density detecting apparatus can be also made operative at a timing such that each time the number of copy sheets reaches a predetermined number, each time the total value of the signal value C reaches a predetermined value, or the like without making the toner density detecting apparatus operative every copying operation, and the error of the toner supplement amount can be also corrected.

According to the embodiment as mentioned above, when the calculated signal value C is equal to ΔC smaller than the threshold value $C_1$, the toner is not supplied but the signal value ΔC is held and accumulated to the signal value C derived by the next image information signal. Sum of (C+ΔC) is again compared with the threshold value $C_1$. Only when (C+ΔC) is equal to or larger than threshold value $C_1$, the signal value (C+ΔC) is converted into the toner supplement time and the toner is supplied for only the toner supplement time. Therefore, the toner is supplied in only the supplement area in which the variation of the supplement amount which occurs when the toner supplement amount is very small is suppressed and in which the toner can be stably supplied, so that the toner can be supplied at a high precision. The toner density of the development agent can be always maintained within the allowable range of the initial set value. Thus, the image of the stable density can be always derived.

Figure 11:
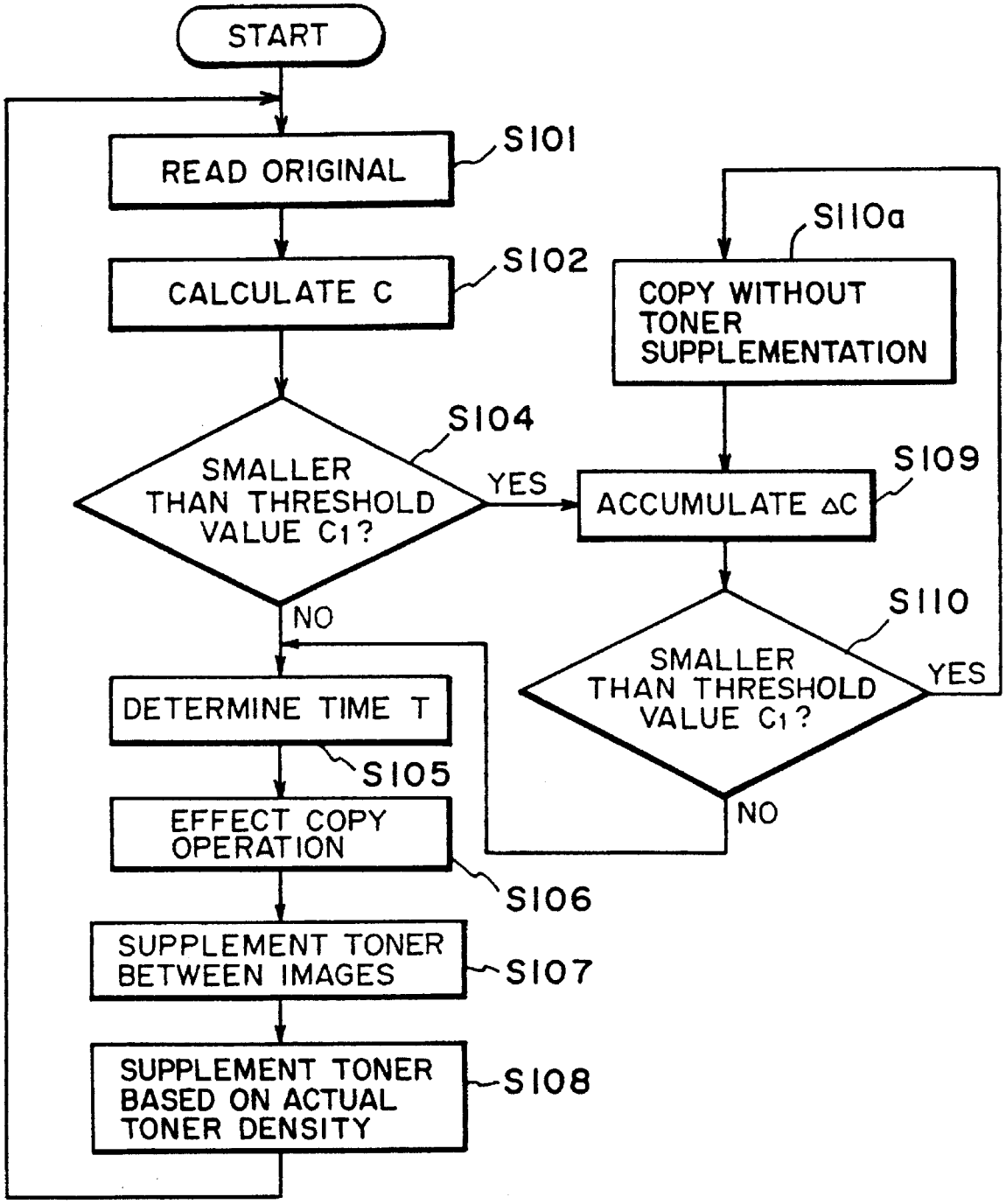
FIG. 11 is a control flowchart of still another example of the invention.

In the embodiment of FIG. 11, the signal value ΔC smaller than the threshold value $C_1$ is accumulated. When the accumulated value is equal to or larger than the threshold value $C_1$, the toner is supplied.

Firstly, when the start button to copy the original is depressed, the original is read in step S101. In step S102, the clock pulse accumulation signal value C is calculated. The signal value C is compared with the threshold value $C_1$ in step S104. When $C<C_1$ (YES in step S104), it is determined that the minute signal value ΔC exists, and the toner is not supplied. In step S109, ΔC is held (for instance, it is stored into-the memory). In step S104, the next signal value C calculated in step S102 is compared with $C_1$. When $C<C_1$, it is likewise determined that there is the minute signal value ΔC, and the toner is not supplied. In step S109, ΔC is accumulated to the minute signal value which has been stored before. In step S110, the accumulated value is compared with the threshold value $C_1$. When the accumulated value is smaller than $C_1$ (YES in step S110), the toner is not supplied. The accumulated value is held in step S109 and copying is performed without toner supplementation (step S110*a*).

On the other hand, when the accumulated value in step S109 is equal to or larger than $C_1$ (NO in step S110), the accumulated value is converted into the toner supplement time T in step S105. In step S106, the copying operation is started and the image forming operations such as latent image formation, development, copy transfer, and the like are executed. When one toner image is formed, in step S107, the screw 30 is rotated for only the time T which has been determined as mentioned above and the toner is supplied before the next toner image is formed. In the next step S108, the toner density detecting apparatus is made operative and the above operations are executed.

When the signal value C from step S102 is equal to or larger than $C_1$ ($C\geqq C_1$) (NO in step S104), the signal value C is converted into the toner supplement time T in step S105 in the ordinary manner. In step S106, the copying operation is started and the image forming operations such as latent image formation, development, copy transfer, and the like as mentioned above are executed. When one toner image is formed, in step S107, the screw 30 is rotated for only the time T which has been determined as mentioned above and the toner is supplied before the next toner image is formed. In step S108, the toner density detecting apparatus is made operative and the above operations are performed.

The similar operations are repeated hereinafter every copying operation.

The toner density detecting apparatus can be also made operative at a timing such that each time the number of copy sheets reaches a predetermined value, each time the total value of the signal value C reaches a predetermined value, or the like and the error of the toner supplement amount can be also corrected without making the toner density detecting apparatus operative every copying operation.

In each of the above embodiments, the clock pulse accumulated value C has been compared with the threshold value $C_1$. However, it is also possible to compare the toner supplement time T which is obtained by converting the accumulated value C and the threshold time value and to execute the similar control operations.

Figure 12:
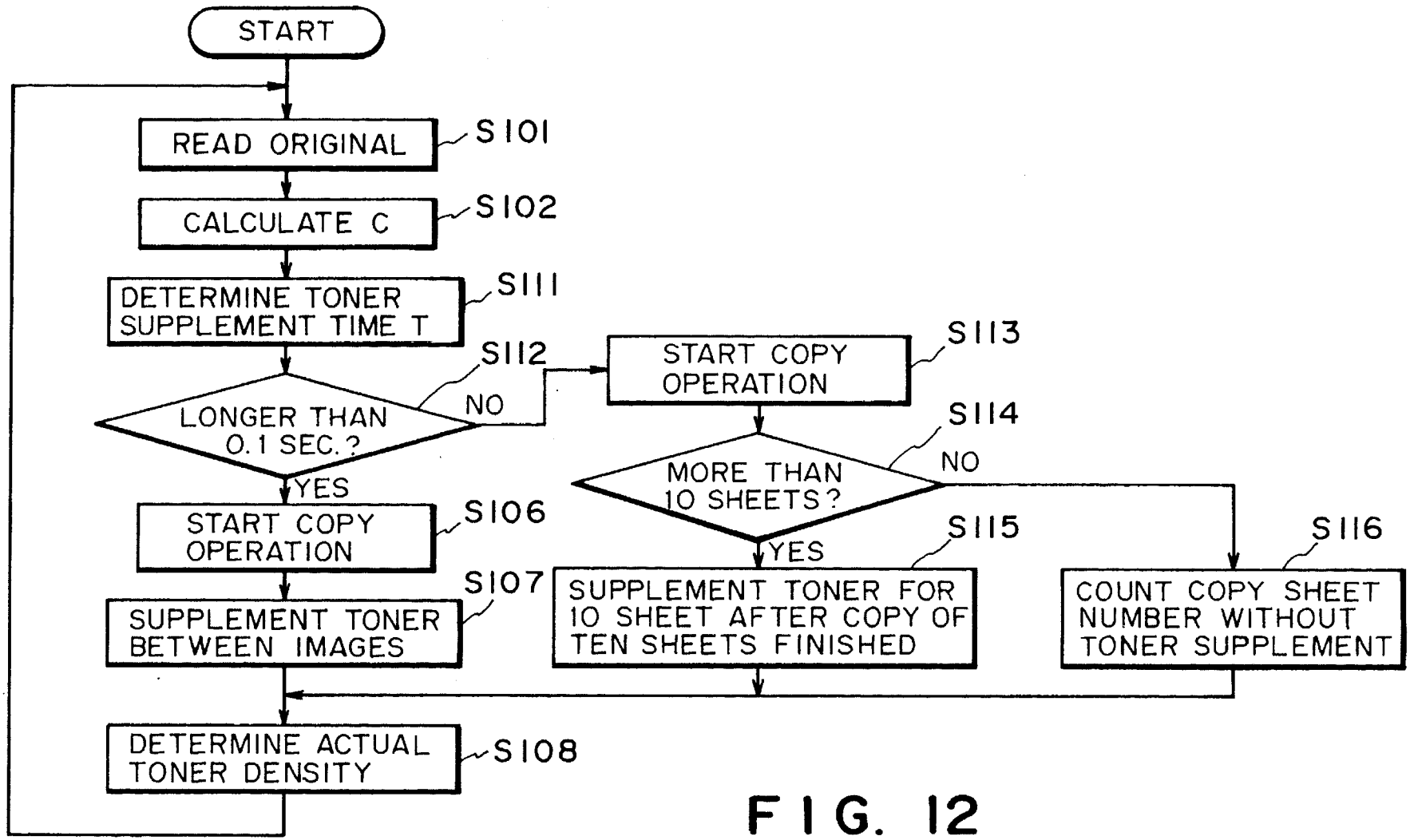
FIG. 12 is a control flowchart of further another example of the invention.

FIG. 12 is a flowchart showing the control operation of another embodiment of the invention. In the embodiment, the threshold value $T_1$ is set for the toner supplement time and when the number of copy sheets in which the time T is less than the threshold value $T_1$ reaches a predetermined value, the toner of the amount corresponding to the predetermined number of sheets is supplied in a lump. In the case where the number of copy sheets is less than the predetermined value, the toner is not supplied.

The signal value C counted in step S102 is converted into the toner supplement time T in step S111. In step S112, the toner supplement time T is compared with the preset threshold value $T_1$ (0.1 second in the embodiment) as a toner supplement time corresponding to the lowest line at which the supplement amount of the toner from the toner supplement vessel 8 becomes stable. When T is equal to or larger than the threshold value $T_1$ (YES in step S112), the copying operation is started in step S106. The image forming operations such as latent image formation, development, copy transfer, and the like as mentioned above are executed. When one toner image is formed, the screw 30 is rotated for only the time T which has been decided as mentioned above and the toner is supplied before the next toner image is formed. In the next step S108, the toner density detecting apparatus is made operative and the above operations are executed.

When the toner supplement time T converted in step S111 is shorter than the threshold value of 0.1 second (NO in step S112), the copying operation is started in step S113. In step S114, a check is made to see if the copy mode to execute the copying operation corresponding to continuous ten or more copy sheets has been set or not. When the number of copy sheets is equal to or larger than continuous ten sheets (YES in step S114), the copying operation of ten sheets is executed and, after that, the toner of the amount corresponding to ten sheets is supplied in a lump in step S115. In the subsequent step S108, the toner density detecting apparatus is made operative and the foregoing operations are executed. When the copying operation corresponds to the number of copy sheets which is less than ten continuous sheets in step S114 (NO in step S114), the toner is not supplied. In step S116, the number of copy sheets is counted. In step S108, the above operations are executed. When the count number in step S116 reaches 10, the toner is supplied. After that, the toner density detecting apparatus is made operative in step S108 and the above operations are performed.

The similar operations are repeated hereinbelow every copying operation.

In the case of the toner of the polyester distributing type whose average grain diameter is equal to about 10 μm, when lack widths of the image of the A4 size in all of the edge portions are equal to 1 mm, the toner supplement time of 0.7 second is required for a full painted image of 100%. Although the threshold value $T_1$ of 0.1 second has been set from the result of the above experiment, it can be properly changed as necessary. The above judging method is not limited to the case of ten continuous sheets but can be also performed on the basis of a predetermined number of sheets such as total ten sheets or a predetermined time such as total 0.1 second. The set value for judgment in the above case is not obviously limited to ten sheets or 0.1 second. Further, the toner density detecting apparatus can be also made operative at a timing such that each time the number of copy sheets reaches a predetermined value, each time the total value of the signal value C reaches a predetermined value, or the like and the error of the toner supplement amount can be also corrected without making the toner density detecting apparatus operative every copying operation.

Figure 13:
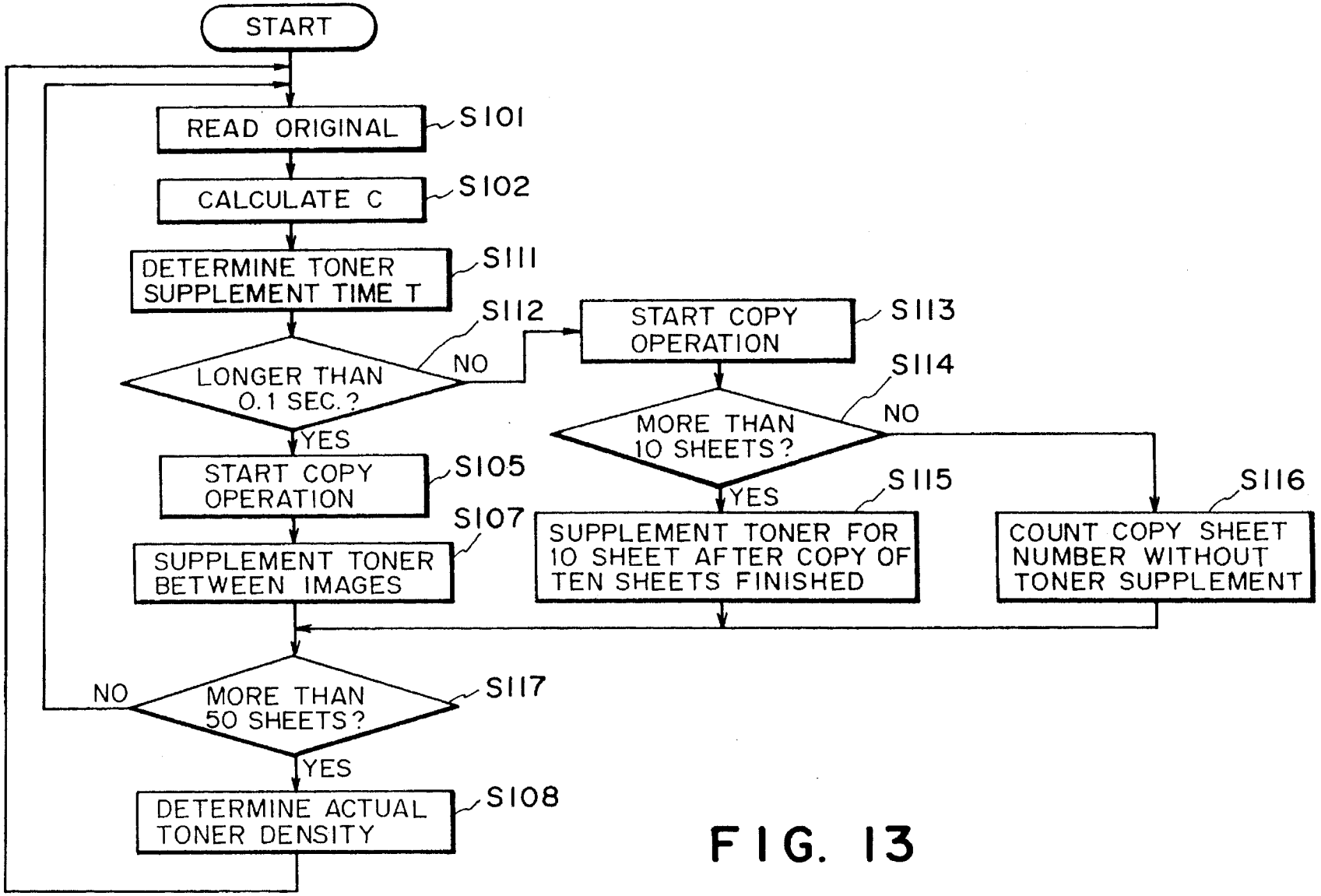
FIG. 13 is a control flowchart of further another example of the invention.

FIG. 13 is a flowchart showing further another embodiment of the invention in which the above control is performed so as to make the toner density detecting apparatus operative when the number of copy sheets reaches, for example, 50 in the embodiment of FIG. 12. In the above toner density detecting apparatus, there is a case where the copy transfer means 27 becomes dirty by a reference image because the reference image is formed on the drum 17. Therefore, the dirt of the copy transfer means can be reduced by making the toner density detecting apparatus operative every predetermined number of copy sheets or every predetermined copying operation as in the above embodiment.

In the embodiment, step S117 of judging whether the total number of copy sheets has reached 50 or not is merely added into the flowchart of the embodiment of FIG. 12. Therefore, its description is omitted here. However, until the number of copy sheets reaches 50 (NO in step S117), the copy sheet number is accumulated and a series of copying operations are continued. When the number of copy sheets reaches 50, the toner density detecting apparatus is made operative in step S108 and the above correction control is executed.

In the above embodiment, the toner is supplied to the developing device after completion of the developing step of the latent image. However, the toner can be also supplied to the developing device during the development of the latent image or before the latent image is developed.

In the above embodiment, the toner supplement time is controlled in correspondence to the presumed toner consumption amount. However, it is also possible to construct in a manner such that a variable speed motor is used as a motor 28 and a rotational speed of the motor 28, namely, a toner supplement speed is controlled in accordance with the presumed toner consumption amount. Or, both of the toner supplement time and the toner supplement speed can be also controlled.

Although the above embodiment has been shown in the case where the invention is applied to a laser beam scanning type copying apparatus of the electrophotographic system, the invention can be also similarly applied to an electrophotographing apparatus in which an information light is exposed to the photo sensitive material by an LED array, an image forming apparatus in which a latent image is formed by an ion generator, or the like. The invention can be also applied to an image forming apparatus in which light and dark states of an image are expressed by the Dither method or an image forming apparatus which forms a toner image by an image information signal generated from a computer or the like.

In the above embodiment, to measure the actual toner density of the developing agent in the developing device, a patch image is formed on the photo sensitive drum and the density of the image is measured. However, it is also possible to use a toner density detecting apparatus of the inductance detecting system in which a permeability of the developing agent in the developing device is detected and the actual toner density is detected by such an output. Alternately, the actual toner density of the developing agent can be also measured by directly irradiating the light to the developing agent on a developing sleeve or the like and by measuring the reflected lights. However, in the case where the toner is colored in black by carbon black, there is not so a large difference between the spectral reflectances of the toner and the carriers. Therefore, according to the above method, a detecting accuracy of the toner density is low, so that it is unpreferable.

What is claimed is:

1. An image forming apparatus, comprising:

an image bearing body;

latent image forming means for forming an electrostatic latent image corresponding to an image signal onto said image bearing body;

developing means for developing the electrostatic latent image by using a developer containing a toner and a carrier;

a supplement mechanism for supplying the toner to said developing means;

counting means for counting a signal value corresponding to an amount of toner consumed by an image formation by using the image signal;

control means for determining a control amount of said supplement mechanism on the basis of the signal value counted by said counting means and for making said supplement mechanism operative in accordance with the control amount, wherein said control means determines the control amount of the supplemental mechanism on the basis of a signal value range, said signal value range being a result of the control means performing a comparison between the counted signal value and predetermined signal values corresponding to an amount of toner; and correcting means for actuating said supplement mechanism in accordance with the determined control amount and an error component of the counted signal value resulting from a difference between a toner amount corresponding to the counted signal value and a toner amount corresponding to the determined control amount.

2. An image forming apparatus according to claim 1, wherein said correcting means accumulates the error component which occurs for every determination of the control amount by said control means and makes said supplement mechanism operative when the accumulated value is equal to or larger than a predetermined value.

3. An image forming apparatus according to claim 1, wherein said correcting means accumulates the error component and the signal value when said control means determines a next control amount.

4. An image forming apparatus, comprising:

an image bearing body;

latent image forming means for forming an electrostatic latent image corresponding to an image signal onto said image bearing body, and for forming a reference latent image corresponding to a reference signal onto said image bearing body;

developing means for developing the electrostatic latent image and the reference latent image by using a developer containing a toner and a carrier;

a supplement mechanism for supplying a toner to said developing means;

counting means for counting a signal value corresponding to an amount of toner consumed by an image formation by using the image signal;

detecting means for detecting an image density of the developed reference latent image; and control means for controlling said supplement mechanism in accordance with the signal value counted by said counting means, wherein said control means controls said supplemental mechanism in accordance with a detected density of the developed reference latent image after a total of the signal value becomes a predetermined value.

5. An image forming apparatus comprising:

an image bearing member;

image forming means for forming an electrostatic image on said image bearing member in accordance with an image signal;

developing means for developing the electrostatic image by a toner;

counting means for counting the image signal;

first supplement means for supplementing the toner amount based on a counted value by said counting means to said developing means;

detecting means for detecting a toner density;

second supplement means for supplementing the toner amount based on a detected value by said detecting means to said developing means; and selecting means for selecting the toner supplemented by said first supplementing means or the toner supplemented by said second supplementing means, in accordance with whether a predetermined number of image formations have been performed.

6. An image forming apparatus according to claim 5, further comprising means for transferring the toner-developed electrostatic image onto a sheet, and wherein said second supplementing means is selected by said selecting means responsive to a predetermined number of sheets.

7. An image forming apparatus according to claim 5, wherein said image forming means is adapted to form a reference image corresponding to a reference signal, and wherein said detecting means detects a toner density of an image obtained by developing the reference image.

8. An image forming apparatus, comprising:

an image bearing member;

image forming means for forming an electrostatic image on said image bearing member in accordance with an image signal;

developing means for developing the electrostatic image by a toner;

counting means for counting the image signal;

first supplement means for supplementing the toner amount based on a counted value by said counting means to said developing means;

detecting means for detecting a toner density;

second supplement means for supplementing the toner amount based on a detected value by said detecting means to said developing means; and selecting means for selecting the toner supplemented by said first supplementing means and the toner supplemented by said second supplementing means, in accordance with whether a predetermined number of image signals have been effected.

9. An image forming apparatus according to claim 8, further comprising accumulating means for accumulating the number of image signals, and comparing means for comparing an accumulated number of image signals with a predetermined value.

10. An image forming apparatus according to claim 8, wherein said second supplementing means is selected by said selecting means responsive to a predetermined number of image formations having been effected.

* * * * *

UNITED STATES PATENT AND TRADEMARK OFFICE

CERTIFICATE OF CORRECTION

PATENT NO. : 5,581,326

DATED : December 3, 1996

INVENTORS : Takao Ogata, et al.

It is certified that error appears in the above-identified patent and that said Letters Patent is hereby corrected as shown below:

COLUMN 1

Line 29, "therefore," should read --therefore--.

COLUMN 2

Line 1, "photo-sensitive" should read --photosensitive--;
Line 14, "formed" should read --formed.--; and
Line 17, "photo sensitive" should read --photosensitive--.

COLUMN 3

Line 52, "making" should read --making the--.

COLUMN 5

Line 32, "shown." should read --shown--.

COLUMN 6

Line 64, "value K" should read --value K.".

UNITED STATES PATENT AND TRADEMARK OFFICE

CERTIFICATE OF CORRECTION

PATENT NO. : 5,581,326

DATED : December 3, 1996

INVENTORS : Takao Ogata, et al.

It is certified that error appears in the above-identified patent and that said Letters Patent is hereby corrected as shown below:

COLUMN 7

Line 15, "S26). The" should read --S26), the--.

COLUMN 8

Line 21, "belt 26" should read --belt 26.--.

COLUMN 9

Line 11, "finished" should read --finished.--.

COLUMN 10

Line 11, "not" should be deleted; and
Line 30, "laser 13" should read --laser 13.--.

COLUMN 11

Line 42, "value C" should read --value C.--.

UNITED STATES PATENT AND TRADEMARK OFFICE

CERTIFICATE OF CORRECTION

PATENT NO. : 5,581,326

DATED : December 3, 1996

INVENTORS : Takao Ogata, et al.

It is certified that error appears in the above-identified patent and that said Letters Patent is hereby corrected as shown below:

COLUMN 12

Line 39, "into-the" should read --into the--; and
Line 47, "S109" should read --S109,--.

COLUMN 15

Line 10, "photo sensitive" should read --photosensitive--;
Line 15, "Dither" should read --dither--;
Line 21, "photo sensitive" should read --photosensitive--; and
Line 33, "a large" should read --large a--.

Signed and Sealed this

First Day of July, 1997

Bruce Lehman

*Attest:*

BRUCE LEHMAN

*Attesting Officer*

*Commissioner of Patents and Trademarks*